US007757472B2

(12) United States Patent
Dold et al.

(10) Patent No.: US 7,757,472 B2
(45) Date of Patent: Jul. 20, 2010

(54) SYNTHETIC FIBER CABLE AND ELEVATOR INSTALLATION WITH SUCH A SYNTHETIC FIBER CABLE

(75) Inventors: Florian Dold, Root (CH); Adolf Bissig, Buochs (CH); Alessandro D'Apice, Adligenswil (CH); Herbert Bachmann, Lucerne (CH); Manfred Wirth, Rotkreuz (CH); Tobias Noseda, Lucerne (CH); Roland Lorenz, Root (CH); Claudio De Angelis, Münster (DE)

(73) Assignee: Inventio AG, Hergiswil NW (CH)

( * ) Notice: Subject to any disclaimer, the term of this patent is extended or adjusted under 35 U.S.C. 154(b) by 188 days.

(21) Appl. No.: 11/863,401

(22) Filed: Sep. 28, 2007

(65) Prior Publication Data

US 2008/0078157 A1 Apr. 3, 2008

(30) Foreign Application Priority Data

Sep. 29, 2006 (EP) ..... 06121572

(51) Int. Cl.
*D02G 3/22* (2006.01)

(52) U.S. Cl. ..... 57/236

(58) Field of Classification Search ..... 57/210, 57/230–232, 236, 237, 241
See application file for complete search history.

(56) References Cited

U.S. PATENT DOCUMENTS

| | | | | |
|---|---|---|---|---|
| 3,111,001 | A | 11/1963 | Schmittmann et al. | |
| 4,202,164 | A | 5/1980 | Simpson et al. | |
| 4,624,097 | A * | 11/1986 | Wilcox | 57/232 |
| 7,086,217 | B2 * | 8/2006 | Eichhorn et al. | 57/241 |
| 7,137,483 | B2 * | 11/2006 | Kato et al. | 187/251 |
| 7,185,482 | B2 * | 3/2007 | Eichhorn | 57/230 |
| 7,191,585 | B2 * | 3/2007 | Vanderbeken et al. | 57/223 |
| 2004/0083707 | A1 * | 5/2004 | Eichhorn et al. | 57/241 |
| 2004/0206579 | A1 | 10/2004 | Baranda et al. | |
| 2004/0231312 | A1 * | 11/2004 | Honda | 57/241 |
| 2005/0274101 | A1 * | 12/2005 | Wang | 57/241 |

FOREIGN PATENT DOCUMENTS

| | | |
|---|---|---|
| EP | 1 004 700 A | 5/2000 |
| EP | 1 061 172 A | 12/2000 |

* cited by examiner

*Primary Examiner*—Shaun R Hurley
(74) *Attorney, Agent, or Firm*—Fraser Clemens Martin & Miller LLC; William J. Clemens

(57) ABSTRACT

A synthetic fiber cable has the strands of a strand layer mutually spaced apart. With the mutual spacing, the strands of the outer strand layer can move radially in the direction of the cable center and exert a radial pressure on the strands of the first inner strand layer. The radial pressure is passed on from the strands of the first inner strand layer to the strands of the second inner strand layer. The radial pressure is passed on from the strands of the second inner strand layer to the core strand. The radial pressure increases inwardly from strand layer to strand layer. The soft cable sheathing does not act as a support between the strands in circumferential direction.

18 Claims, 3 Drawing Sheets

SYNTHETIC FIBER CABLE AND ELEVATOR INSTALLATION WITH SUCH A SYNTHETIC FIBER CABLE

FIELD OF THE INVENTION

The invention relates to a synthetic fiber cable consisting of strands, which are arranged stranded in at least one strand layer. In addition, it relates to an elevator installation with such a synthetic fiber cable.

BACKGROUND OF THE INVENTION

A synthetic fiber cable for an elevator installation with strands stranded in multiple layers is known from the specification EP 1 004 700 A2, in which a coating of the strands is provided instead of an extruded, protective synthetic material sheathing. The strands of each strand layer are mutually supporting in circumferential direction. The strands of the outermost strand layer are treated with an impregnant which ensures reliable protection against environmental influences as well as an adequate abrasion resistance.

A support cable constructed from aramide fibers has become known from the specification U.S. Pat. No. 4,202,164. Several aramide fibers form a thread and several threads form a strand. Several strands arranged around a core strand form the support cable, wherein the strands are completely embedded in an extruded thermoplastic. During manufacture of the strand, the cavities between the threads are filled with a lubricant.

SUMMARY OF THE INVENTION

Here the present invention will create a remedy. The present invention meets the object of creating a supporting and drive means in the form of a synthetic fiber cable with optimal transmission of the traction forces from strand layer to strand layer. The invention also relates to an elevator installation with such supporting and drive means.

The advantages achieved by the present invention are substantially to be seen in that the synthetic fiber cable functions correctly and the service life of the synthetic fiber cable is thereby extended. The synthetic fiber cable according to the present invention is usually used as a supporting and drive means, for example of an elevator installation, wherein the supporting and drive means is guided over at least one drive pulley and over deflecting rollers and has to withstand bending in alternation. The safety of the elevator installation is also improved by the synthetic fiber cable according to the present invention.

When a supporting and drive means runs over a drive pulley of the elevator drive, traction forces resulting from the weight difference between counterweight and car are applied in the supporting means longitudinal direction. These traction forces have to be introduced uniformly over the entire supporting means cross-section so as to achieve an optimum of service life and reliability of the supporting and drive means or the synthetic fiber cable.

The transmission of the traction force takes place by way of friction forces between drive pulley and cable sheathing. The introduction of the traction forces between sheathing and outer strands of the synthetic fiber cable is problem-free in itself, since the sheathing is fixedly connected with the outer strands. However, it is problematic to transfer the traction forces from the outer strands to the inner strands when the strand layers and their strands are displaceable relative to one another. The force transfer between outer strands and inner strands takes place by way of friction forces.

In order to be able to transmit friction forces, a normal force and a coefficient of friction should have a defined level. The necessary normal force is applied by setting the radial pressing pressure of the outer strands on the inner strands. The coefficients of friction between the inner and outer strands are quite small particularly in the case of lubricated strands. Even with unlubricated strands, the coefficients of friction lie in a relatively low range of $\mu$=0.2 to 0.45. This region should not be fallen below, so that the shear forces can be permanently transmitted without lasting change of the cable structure. The coefficients of friction between the strands have to be relatively high for the transmission of traction. However, high coefficients of friction cause an increased wear of the strands. With coefficients of friction which are too low, individual strand layers can displace relative to one another. The coefficient of friction range of $\mu$=0.2 to 0.45 has proved ideal with respect to wear and traction transfer from numerous tests and can be achieved by means of dry lubricant (for example 'Teflon' powder).

The normal force necessary for transfer of traction force arises through the introduction of tension force into the outer strands, which constrict inwardly and exert a radial pressing pressure, also termed constriction pressure, on the inner strands. However, the outer strands can exert only a radial pressure inwardly when they can move radially in the direction of the cable center. If the radial degree of freedom is blocked, no radial pressure can be exerted. Outer strands with a diameter which is too large form, together with the strands of the same layer, an arch and are not in a position of radially moving further inwardly. Accordingly, a spacing has to be given in a circumferential direction particularly between the individual outer strands.

The supporting and drive means according to the present invention in the form of a synthetic fiber cable consists of strands arranged stranded in at least one strand layer, wherein the strands of a strand layer are mutually spaced apart in circumferential direction without the strands being embedded.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
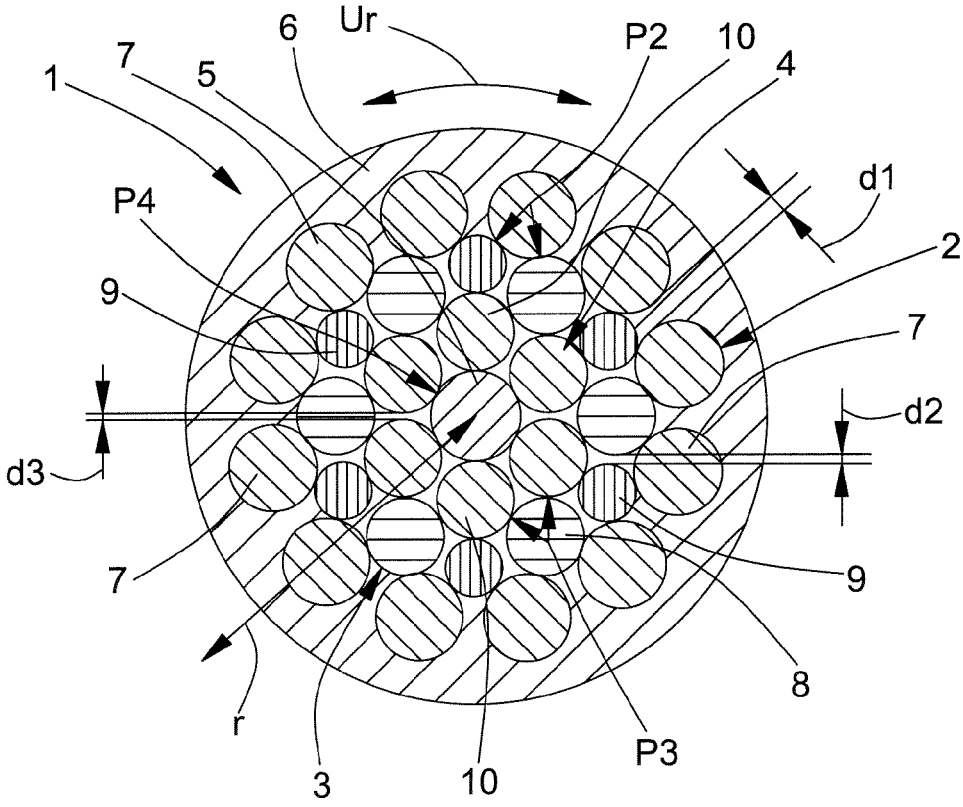
FIG. 1 shows a synthetic fiber cable according to the present invention in cross-section.

FIG. 1 shows a synthetic fiber cable 1 according to the present invention. The synthetic fiber cable 1 comprises several strand layers, an outer strand layer 2, a first inner strand layer 3, a second inner strand layer 4 and a core layer 5. A cable sheathing is denoted by 6. Construction and diameter of the strands 7 of the outer strand layer 2 are identical. The first inner strand layer 3 consists of, in diameter, larger strands 8 and smaller strands 9. The larger strands 8 approximately correspond in diameter with the strands 10 of the second inner strand layer 4 and of the core strand 5. The strands 7 of the outer strand layer 2 are larger in diameter than the larger strands 8 of the first inner strand layer 3 and of the strands 10 of the second inner strand layer 4. The larger strands 8 of the inner strand layers 3, 4 are larger in diameter than the smaller strands 9 of the first inner strand layer 3. The larger strands 8 of the first strand layer 3 and the strands 10 of the second inner strand layer 4 are, in diameter, of approximately the same size as the slightly larger diameter core strand 5. The strands 10 of the second inner strand layer 4 are stranded around the core strand 5, the strands 8, 9 of the first inner strand layer 3 are stranded around the second strand layer 4 and the strands 7 of the outer strand layer 2 are stranded around the first inner strand layer 3.

A strand 5, 7, 8, 9, 10 consists of stranded threads, which in turn consist of unstranded or unidirectional synthetic fibers, wherein a thread consists of, for example, 1,000 synthetic fibers, also termed filaments. The stranding direction of the threads in the strands is provided so that the individual fiber is oriented in the tensile direction of the cable or in the cable longitudinal axis. Each thread is impregnated in a synthetic material bath. The synthetic material surrounding a thread or a strand is also termed matrix or matrix material. After stranding of the threads to form a strand the synthetic material of the threads is homogenized by means of a heat treatment. The strands then have a smooth strand surface and then consist of stranded threads completely embedded in the synthetic material.

The fibers are connected together by the matrix, but have no direct contact with one another. The matrix completely encloses or embeds the fibers and protects the fibers from abrasion and wear. Due to the cable mechanics, displacements occur between the individual fibers in the strands. These displacements are not translated by way of a relative movement by way of a relative movement between the filaments, but by a reversible stretching of the matrix.

The degree of filling of the strands describes the behavior of the fiber component relative to the matrix. This degree of filling can be defined by way of the proportional area of the fibers to the total cross-section, as also by the weight proportion of the fibers to the total weight. The degree of filling in the currently employed aramide strands is between 35 to 80 area percent, or 35 to 80% of the strand cross-sectional area consists of fibers and the rest of matrix material.

The synthetic fiber cable 1 can be constructed from chemical fibers such as, for example, aramide fibers, Vectran (Kuraray Co., Ltd., Japan) fibers, polyethylene fibers, polyester fibers, etc. The synthetic fiber cable 1 can also consist of one or two or three or more than three strand layers.

FIG. 1 shows the synthetic fiber cable 1 according to the present invention in which the strands of a strand layer are mutually spaced apart. The spacing between two strands 7 of the outer strand layer 2 is denoted by d1. The spacing between two strands 8, 9 of the first inner strand layer 3 is denoted by d2. The spacing between two strands 10 of the second inner layer 4 is denoted by d3. For example, d1 can lie in the range of 0.05 millimeters to 0.3 millimeters and d2 and d3 in the range of 0.01 millimeters to 0.08 millimeters. For preference d1=0.2 millimeters, d2=0.03 millimeters and d3=0.03 millimeters. The spacing between the individual strands is predetermined by the strand diameter, lay length and number of strands per strand layer.

With the mutual spacing apart of the strands of the strand layer, the strands of the strand layer can freely move in radial direction r in the direction of the cable center. The strands of an outer strand layer exert a radial pressure on the strands of an inner strand layer. The strands 7 of the outer strand layer 2 exert a radial pressure on the strands 8, 9 of the first inner strand layer 3, as is symbolized by the arrows P2. The radial pressure is passed on from the strands 8, 9 of the first inner strand layer 3 to the strands 10 of the second inner strand layer 4, as is symbolized by the arrows P3. The radial pressure is passed on from the strands 10 of the second inner strand layer 4 to the core layer 5, as is symbolized by the arrow P4. The radial pressure increases inwardly from strand layer to strand layer.

Each strand 7 of the outer strand layer 2 is supported on two strands 8, 9 of the first inner strand layer 3. Each smaller strand 9 of the first inner strand layer 3 is supported on a strand 10 of the second inner strand layer 4. Each larger strand 8 of the first inner strand layer 3 is supported on the same strand 10 as the smaller strand 9 and on a further strand 10 of the second inner strand layer 4.

The diametral ranges or optimal diameters of the individual strands can, for example in the case of a lay length of 80 millimeters, be selected as follows: strand 5: diameter range 1.55 millimeters to 1.85 millimeters, diameter 1.66 millimeters; strand 7: diameter range 1.85 millimeters to 2.15 millimeters, diameter 1.97 millimeters; strand 8: diameter range 1.55 millimeters to 1.85 millimeters, diameter 1.66 millimeters; strand 9: diameter range 1.15 millimeters to 1.45 millimeters, diameter 1.28 millimeters; strand 10: diameter range 1.45 millimeters to 1.75 millimeters, diameter 1.58 millimeters.

The cable sheathing 6, which is very much softer by comparison with the strands 7, reaches approximately to the first inner strand layer 3 and does not have any influence on the mutual support of the strands 7. The soft cable sheathing 6 does not act in circumferential direction Ur as a support between the strands 7. The strands 7 of the outer strand layer 3 are in a position of moving radially inwardly. The sheathing material can, for example, lie in the Shore hardness range 75 A to 95 A and the matrix material of the strands can, for example, lie in the Shore hardness range of 50 D to 75 D.

The synthetic fiber cable 1 can also manage without the cable sheathing 6, but the cable construction has to be slightly changed in that the outer strand layer 2 is stranded oppositely (in counter lay) relative to the inner strand layers 3, 4.

If the strands 7, 8, 9, 10 of the respective strand layer were to hit against one another as seen in circumferential direction Ur, the traction forces could not be transmitted from the strands 7 of the outermost strand layer 2 to the strands 8, 9 of the first inner strand layer 3 and not from this to the strands 10 of the second inner strand layer 4 and further to the core strand 5.

Figure 2:
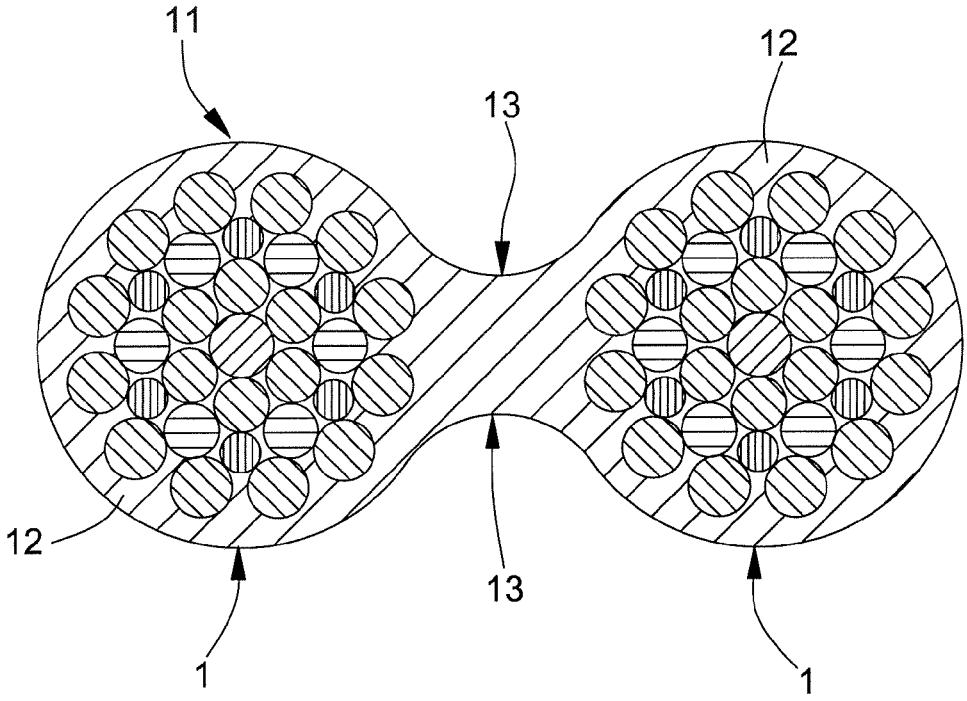
FIG. 2 shows a supporting and drive means according to the present invention with more than one synthetic fiber cable.

FIG. 2 shows a supporting and drive means for an elevator with two load-bearing synthetic fiber cables 1, which are encased by a common, integral sheathing 12, according to FIG. 1 and which form a double cable 11. The double cable 11 can, between the synthetic fiber cables 1, be constructed together with the sheathing 12 as a flat cable or can have a narrowing 13 between the synthetic fiber cables 1. In the case of the variant with the narrowing 13 the common engagement surface of the double cable 11 with the drive pulley is formed, as seen in cross-section, by approximately a semicircle of the synthetic fiber cable 1 and half the narrowing 13. The drive pulley surface is approximately complementary to the profile of the double cable 11. In addition, more than two synthetic fiber cables 1 can be encased by a common sheathing and form a multiple cable with and without narrowing between the synthetic fiber cables 1.

Figure 3:
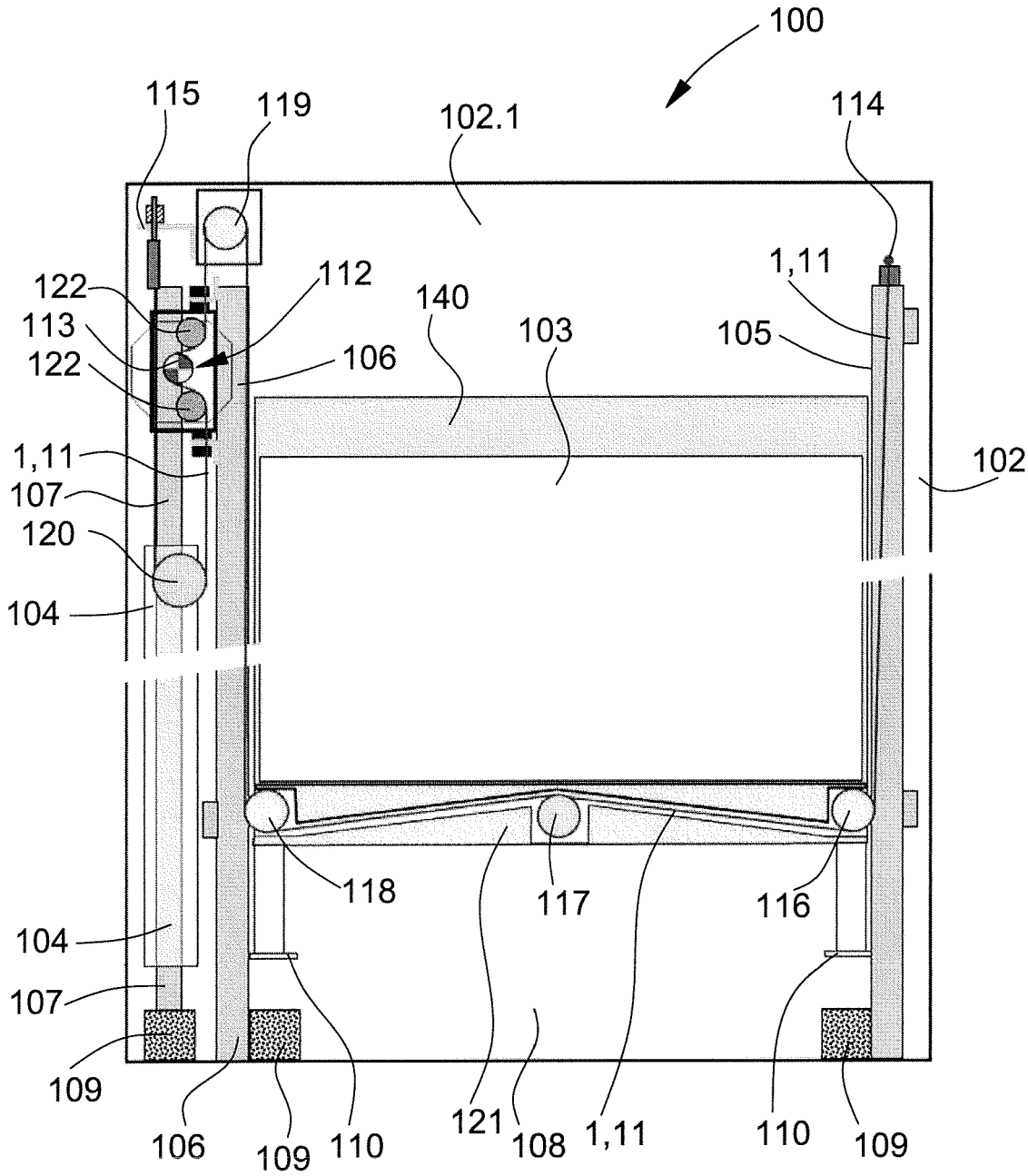
FIG. 3 is a schematic view of a elevator installation with the synthetic fiber cable or supporting and drive means according to the present invention.

An elevator installation denoted by 100 and consisting of an elevator car 103 and a counterweight 104 movable in an elevator shaft 102 is illustrated in FIG. 3. The elevator car 103 with floor 121 and ceiling 140 is guided by means of a first guide rail 105 and by means of a second guide rail 106. The counterweight 104 is guided by means of a third guide rail 107 and by means of a fourth guide rail (not illustrated). The guide rails are supported in a shaft pit 108, wherein the vertical forces are conducted into the shaft pit 108. The guide rails 105, 106, 107 are connected by brackets (not illustrated) with the shaft wall. Arranged in the shaft pit 108 are buffers 109 on which buffer plates 110 of the elevator car 103, or the counterweight 104, can set down.

The synthetic fiber cable 1 or double cable 11 according to the present invention can be provided as supporting and drive means with a 2:1 belt guidance. If a mechanical linear drive 112, which is arranged at the second guide rail 106, for example in the shaft head 102.1, advances the synthetic fiber cable 1 or double cable 11 by means of a drive wheel 113 by one unit, the elevator car 103 and the counterweight 104 move by half a unit. The transmission of the traction force takes place, as explained further above, by way of friction forces between drive wheel and cable sheathing. One end of the synthetic fiber cable 1 or double cable 11 is arranged at a first cable fixing point 114 and the second end of the synthetic fiber cable 1 or the double cable 11 is arranged at a second cable fixing point 115. The synthetic fiber cable 1 or double cable 11 is guided over a first deflecting roller 116, a profiled roller 117, a second deflecting roller 118, a third deflecting roller 119, the drive wheel 113 and a fourth deflecting roller 120. The third deflecting roller 119 arranged at the second guide rail 106 has a brake for normal operation. Diverting rollers 122 of the linear drive 112 increase the angle of looping of the synthetic fiber cable 1 or double cable 11 at the drive wheel 113. The motor or motors for the drive wheel 113 is or are not illustrated. The fourth deflecting roller 120 is arranged in the counterweight 104 and is comparable in construction with the first deflecting roller 116 or with the second deflecting roller 118.

The synthetic fiber cable 1 or the support and drive means 11 can also be used for other known elevator drives.

Figure 4:
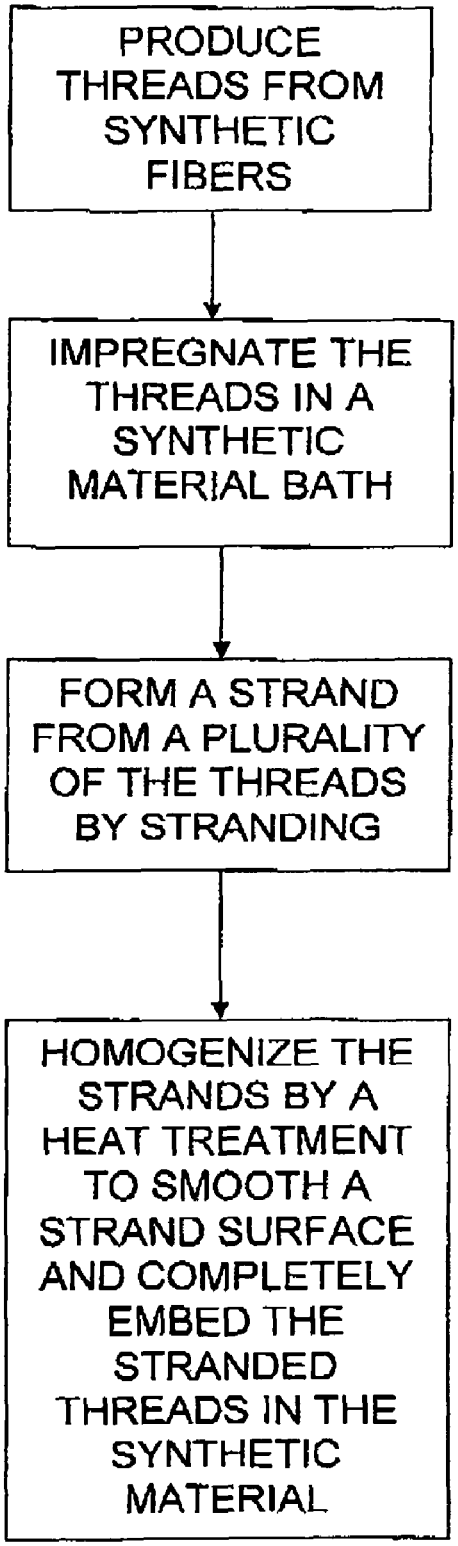
FIG. 4 is a flow diagram of method of producing the synthetic fiber cable according to the present invention.

The method of producing the synthetic fiber cable 1 is set forth in the flow diagram of FIG. 4. The strands 5, 7, 8, 9, 10 are produced from stranded threads, which in turn are produced from unstranded or unidirectional synthetic fibers. Each thread is impregnated in a synthetic material bath. The synthetic material surrounding a thread or a strand is also termed matrix or matrix material. After stranding of the threads to form a strand, the synthetic material of the threads is homogenized by means of a heat treatment to smooth the strand surface and completely embed the stranded threads in the synthetic material.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A synthetic fiber cable having a plurality of strands comprising:

an outer strand layer having a first plurality of strands; and an inner strand layer having a second plurality of strands, said strands of said inner strand layer being mutually spaced apart in a circumferential direction, wherein said strands of said outer strand layer can move in a radial direction toward a center of the cable and exert a radial pressure on said strands of said inner strand layer and the radial pressure increases in an inwardly direction.

2. The synthetic fiber cable according to one of claim 1 wherein the mutual spacing of said strands in a circumferential direction is predetermined by a strand diameter, a lay length and a number of the strands per strand layer.

3. The synthetic fiber cable according to claim 1 including said outer strand layer, said inner strand layer as a first inner strand layer, a second inner strand layer with a third plurality of strands disposed inwardly from said first inner strand layer and a core strand at the center of the cable.

4. The synthetic fiber cable according to claim 3 wherein a mutual spacing of said strands of said outer strand layer is in a range of 0.05 millimeters to 0.3 millimeters, a mutual spacing of said strands of said first inner strand layer is in a range of 0.01 millimeters to 0.08 millimeters and a mutual spacing of said strands of said second inner strand layer is in a range of 0.01 millimeters to 0.08 millimeters.

5. The synthetic fiber cable according to claim 3 wherein said strands of said outer strand layer are in a diameter range of 1.85 millimeters to 2.15 millimeters, said strands of said first inner strand layer are in a diameter range of 1.55 millimeters to 1.85 millimeters or in a diameter range of 1.15 millimeters to 1.45 millimeters, said strands of said second inner strand layer are in a diameter range of 1.45 millimeters to 1.75 millimeters and said core strand is in a diameter range of 1.55 millimeters to 1.85millimeters.

6. The synthetic fiber cable according to claim 5 wherein strands of said first inner strand layer include smaller diameter strands each supported on one of said strands of said second inner strand layer, each of said strands of said second inner strand layer being supported on said core strand, said strands of said first inner layer including larger diameter strands each supported on two of said strands of said second inner strand layer, and said strands of said outer strand layer are each supported by one of said smaller diameter strands and one of said larger diameter strands.

7. The synthetic fiber cable according to claim 1 wherein coefficients of friction between said strands are in a range of 0.2 to 0.45.

8. The synthetic fiber cable according to claim 1 wherein said outer strand layer is encased by a cable sheathing and said cable sheathing extends inwardly to approximately said first inner strand layer.

9. The synthetic fiber cable according to claim 8 wherein said sheathing is formed of a material having a Shore hardness in a range of 75 A to 95 A.

10. The synthetic fiber cable according to claim 8 wherein said strands are encased in a matrix material having a Shore hardness in a range of 50 D to 75 D.

11. A supporting and drive means for an elevator with at least two synthetic fiber cables according to claim 1 encased by a common integral sheathing.

12. A supporting and drive means according to claim 11 wherein said sheathing has a narrowing between said two synthetic fiber cables.

13. An elevator installation having a synthetic fiber cable according to claim 1 connected between an elevator car and a counterweight.

14. The elevator installation according to claim 13 wherein said synthetic fiber cable is guided over a drive wheel and moves said elevator car and said counterweight.

15. A method of producing a synthetic fiber cable according to claim 1 including the steps of:

a. producing threads from synthetic fibers;

b. impregnating the threads in a synthetic material bath;

c. forming a strand from a plurality of the threads by stranding;

d. homogenizing the strand by a heat treatment to smooth a strand surface and completely embedding the stranded threads in the synthetic material;

e. performing the steps a. through d. to form the plurality of strands; and f. assembling the plurality of stands together to form synthetic fiber cable.

16. A synthetic fiber cable having a plurality of strands comprising:

an outer strand layer having a first plurality of strands mutually spaced apart in a circumferential direction in a first predetermined spacing range;

a first inner strand layer having a second plurality of strands mutually spaced apart in a circumferential direction in a second predetermined spacing range, said first inner strand layer being positioned inwardly of said outer strand layer;

a second inner strand layer having a third plurality of strands mutually spaced apart in a circumferential direction in a third predetermined spacing range, said second inner strand layer being positioned inwardly of said first inner strand layer; and a core strand at a center of the cable wherein said strands of said outer strand layer can move in a radial direction toward the core strand and exert a radial pressure on said strands of said first and second inner strand layers and the radial pressure increases in an inwardly direction.

17. The synthetic fiber cable according to claim 16 wherein the first predetermined spacing range is 0.05 millimeters to 0.3 millimeters, the second predetermined spacing range is 0.01 millimeters to 0.08 millimeters and the third predetermined spacing range is 0.01 millimeters to 0.08 millimeters.

18. A synthetic fiber cable having a plurality of strands comprising:

an outer strand layer having a first plurality of strands mutually spaced apart in a circumferential direction; and an inner strand layer having a second plurality of strands mutually spaced apart in a circumferential direction, wherein said strands of said outer strand layer can move in a radial direction toward a center of the cable and exert a radial pressure on said strands of said inner strand layer and the radial pressure increases in an inwardly direction and wherein coefficients of friction between said strands are in a range of 0.2 to 0.45.

* * * * *